US010795280B2

(12) United States Patent
Seki

(10) Patent No.: US 10,795,280 B2
(45) Date of Patent: Oct. 6, 2020

(54) IMAGE FORMING APPARATUS

(71) Applicant: CANON KABUSHIKI KAISHA, Tokyo (JP)

(72) Inventor: Hirotaka Seki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/738,567

(22) Filed: Jan. 9, 2020

(65) Prior Publication Data

US 2020/0225600 A1 Jul. 16, 2020

(30) Foreign Application Priority Data

Jan. 10, 2019 (JP) ..... 2019-002581

(51) Int. Cl.

| | |
|---|---|
| ***G03G 15/043*** | (2006.01) |
| ***G03G 21/20*** | (2006.01) |
| *G03G 15/041* | (2006.01) |
| *G03G 15/04* | (2006.01) |

(52) U.S. Cl.

CPC ..... *G03G 15/043* (2013.01); *G03G 21/20* (2013.01); *G03G 15/0415* (2013.01); *G03G 15/04054* (2013.01)

(58) Field of Classification Search

CPC ..... G03G 15/0409; G03G 15/04054; G03G 15/041; G03G 15/0415; G03G 15/043; G03G 15/0435; G03G 21/20

See application file for complete search history.

(56) References Cited

U.S. PATENT DOCUMENTS 8,836,745 B2 * 9/2014 Sato ..... G03G 15/04054 347/245
2010/0060704 A1 3/2010 Tsuchiya
2013/0286144 A1 * 10/2013 Nakahata ..... G03G 15/043 347/224

FOREIGN PATENT DOCUMENTS

JP 2007-152717 A 6/2007
JP 2010-064338 A 3/2010

* cited by examiner

*Primary Examiner* — Hoang X Ngo
(74) *Attorney, Agent, or Firm* — Venable LLP

(57) ABSTRACT

An image forming apparatus includes a photosensitive drum; an exposure portion including light emitting elements; and a controller configured to control activation of the light emitting elements. The exposure portion includes array chips, each including the light emitting elements, a substrate on which the array chips are arranged in a staggered fashion in the rotational axis direction, and a substrate temperature detecting portion. The controller includes a correcting portion configured to correct magnification of the image data with respect to the rotational axis direction depending on a length fluctuation amount of the substrate calculated on the basis of the temperature detected by the temperature detecting portion, and a converting portion. Depending on magnification correction by the correcting portion, the image data is arranged by the converting portion on the basis of the mounting positions of the array chips.

6 Claims, 11 Drawing Sheets

IMAGE FORMING APPARATUS

FIELD OF THE INVENTION AND RELATED ART

The present invention relates to an image forming apparatus of an electrophotographic type.

In a printer which is an electrophotographic image forming apparatus, the following exposure method (type) is generally known. That is, a method of exposing a photosensitive drum using an exposure head, such as an LED (Light Emitting Diode) or organic EL (Organic Electro Luminescence), to form a latent image is generally known. The exposure head comprises a light emitting element array arranged in the longitudinal direction of the photosensitive drum, and a rod lens array which forms an image of light from the light emitting element array on the photosensitive drum. LEDs and organic ELs having a surface-emitting shape in which the direction of light emitted from the light-emitting surface is the same as that of the rod lens array are known. Here, the length of the light emitting element array is determined depending on the width of the image area on the photosensitive drum, and the interval between the light emitting elements is determined according to the resolution of the printer. For example, in the case of a 1200 dpi printer, the pixel spacing is 21.16 μm, and therefore, the spacing between the adjacent light emitting elements is also the spacing corresponding to 21.16 μm. A printer which uses such an exposure scan of a photosensitive drum with a laser beam deflected by a rotating polygonal mirror uses a smaller number of parts, and therefore, downsizing of equipment and cost reduction are easy. In addition, in a printer using an exposure head, the sound generated by the rotation of the rotary polygonal mirror is eliminated.

In the image forming apparatuses in recent years, colorization has quickly advanced, and an image forming apparatus, in which photosensitive drums corresponding to respective colors and a plurality of image forming portions including surface light emitting element array chips and which outputs multi-color images, has been put into practical use. On the other hand, the LEDs involve heat generation during light emission. For this reason, a heat generation amount of LED arrays including many light emitting portions becomes large. By the influence of this heat generation amount, thermal expansion of a substrate on which the LED arrays are mounted may occur, so that a length of the substrate with respect to a main scan direction of the substrate becomes long and thus a width of an image formed (written) on the photosensitive drum also becomes long. In general, light emission patterns of the respective colors of a color image are different from each other. For this reason, light emission amounts and temperature rise amounts of the respective LEDs arrays are also different from each other. As a result, due to a difference in temperature rise amount of the respective colors, a change amount of the width of the image formed on the photosensitive drum also differs among the respective colors, so that there was a problem such that an image deviation among the respective colors occurs.

Therefore, for example, in Japanese Laid-Open Patent Application (JP-A) 2010-64338, in 60 light emitting chips each including 260 light emitting thyristors arranged in one row (line), not only is a light emission signal supplied to each of the light emitting chips, but also the light emitting thyristors are divided into a plurality of groups, each consisting of two continuous light emitting thyristors in each of the light emitting chips. The two light emitting thyristors as one group constituting each of the plurality of the groups into which the light emitting thyristors are divided are set as a unit for light emission or non-light emission, grouping of the 260 light emitting thyristors of each of the light emitting chips is regarded as one fixing unit, and a change in image width due to the difference in temperature rise amount is corrected. A technique such that this light emission signal generating portion is provided for each of the light emitting thyristors divided into the groups and the image deviation with respect to a main scan direction is suppressed has been proposed.

Further, for example, in JP-A 2007-152717, an LED array comprising a plurality of LEDs which are orderly arranged and an adjusting means for adjusting a relative angle between a photosensitive member and the LED array depending on a fluctuation in length with respect to the main scan direction of this LED array are provided. A technique such that the adjusting means changes an angle of the LED array relative to the photosensitive member about a rotation shaft provided with respect to a direction perpendicular to a rotational axis direction of the photosensitive member and thus a main scan image deviation occurring due to thermal expansion is suppressed has been proposed.

However, in the proposal in JP-A 2010-64338, magnification adjustment (correction) with respect to the main scan direction is made using the 260 light emitting thyristors as a unit, and therefore, with respect to a length of about 300 mm in the main scan direction, 55 main scan magnification adjusting circuits are needed. Further, the 260 light emitting thyristors are merely about 5.5 mm in length. In the light emitting thyristors of about 5.5 mm, for example, in order to cause one pixel, i.e., at 1200 dpi, to less emit the light, when the length of the LED array with respect to the main scan direction is adjusted, a main scan magnification correction trace remains as a vertical stripe and leads to a deterioration of an output image.

Further, in the proposal disclosed in JP-A 2007-152717, the LED array is rotated about the rotation shaft provided with respect to the direction perpendicular to the rotational axis direction of the photosensitive member depending on the fluctuation in length with respect to the main scan direction, and therefore, a distance between the photosensitive member and the LED array changes depending on each of main scan positions. The fluctuation in length between the photosensitive member and the LED array has a great influence on a spot shape change on the photosensitive member, and as a result, a spot is out of focus, so that the spot shape change leads to the deterioration of the output image. Further, a mechanism for rotating the LED array is needed additionally, and for that reason, there also arises a problem such that a cost is increased.

SUMMARY OF THE INVENTION

According to an aspect of the present invention, there is provided an image forming apparatus, comprising: a rotatable photosensitive drum; an exposure portion including a plurality of light emitting elements which are arranged in a rotational axis direction of the photosensitive drum and which emit light to which the photosensitive drum is exposed; and a controller configured to control activation of the light emitting elements by outputting image data to the exposure portion, wherein the exposure portion comprises, a plurality of array chips each including the light emitting elements, a substrate on which the array chips are arranged in a staggered fashion in the rotational axis direction, and a temperature detecting portion configured to detect a temperature of the substrate, wherein the controller comprises, a correcting portion configured to correct magnification of the image data with respect to the rotational axis direction depending on a length fluctuation amount of the substrate with respect to the rotational axis direction calculated on the basis of the temperature detected by the temperature detecting portion, and a converting portion configured to arrange the image data on the basis of mounting positions of the array chips arranged in the staggered fashion, and wherein depending on magnification correction by the correcting portion, the image data is arranged by the converting portion on the basis of the mounting positions of the array chips.

Further features of the present invention will become apparent from the following description of exemplary embodiments with reference to the mounted drawings.

Figure 2:
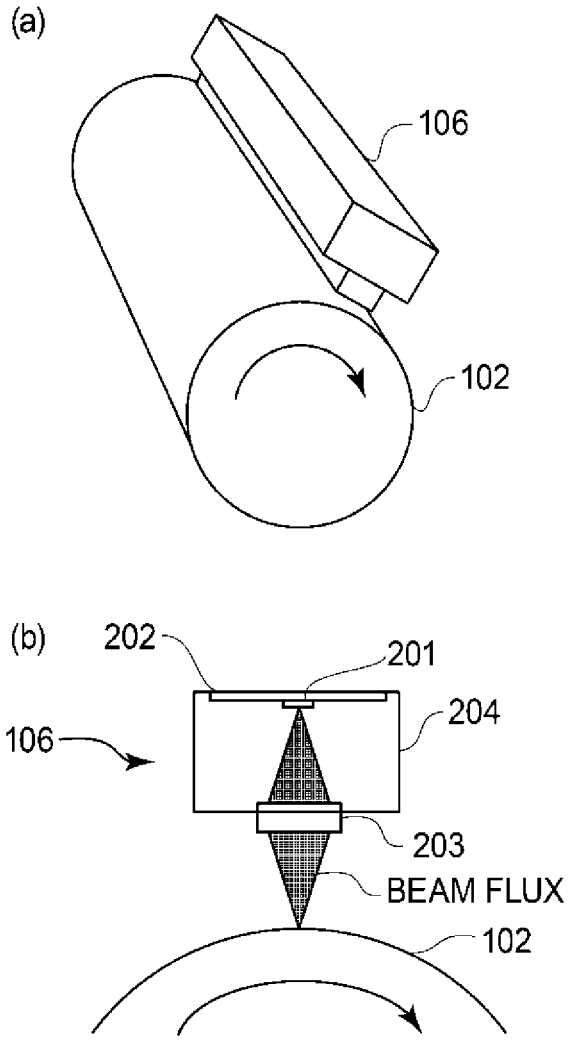

Parts (a) and (b) of FIG. 2 are views illustrating a positional relationship between an exposure head and a photosensitive drum in the embodiment, and a view illustrating a structure of an exposure head.

Figure 3:
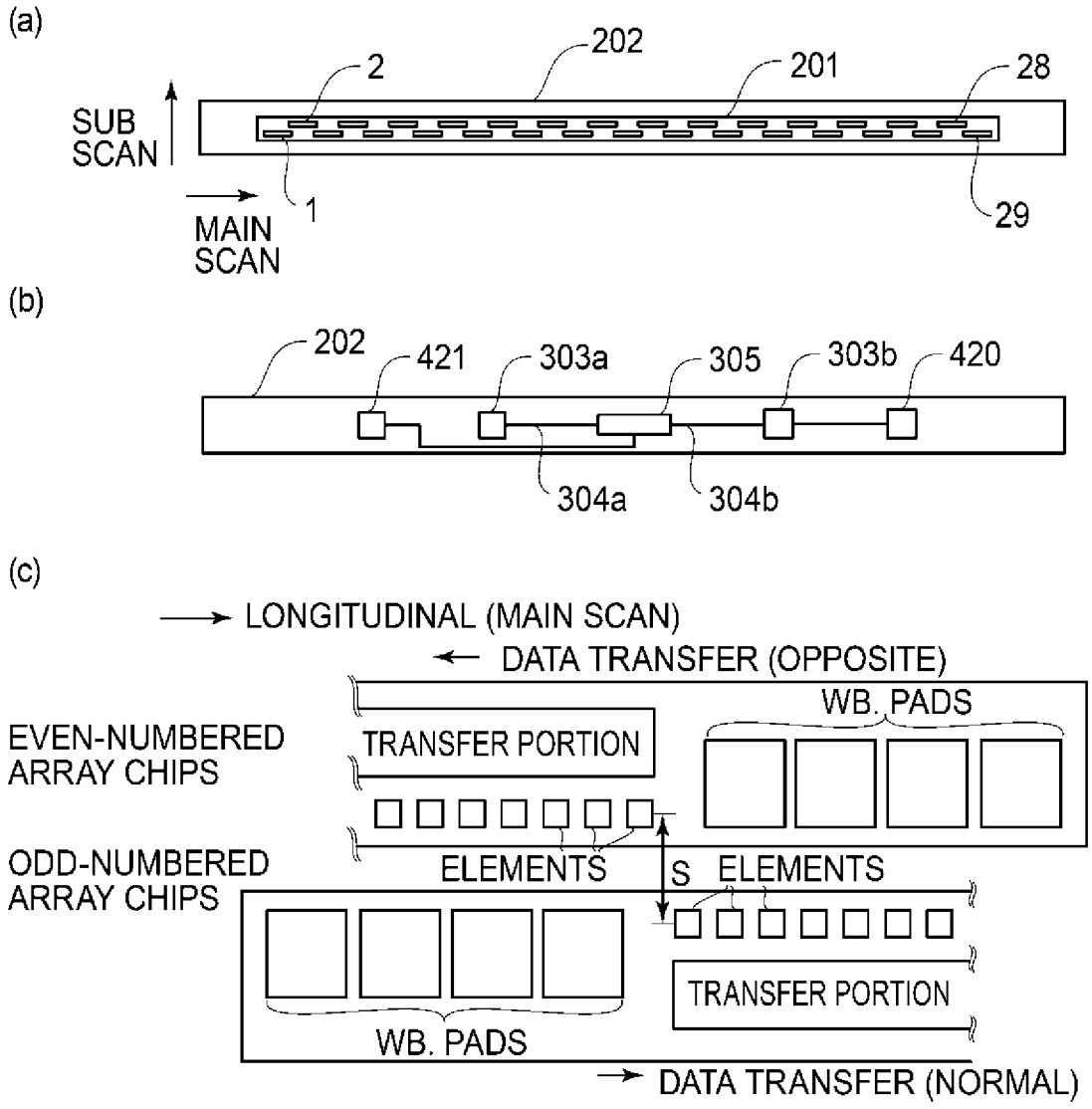

Parts (a), (b) and (c) of FIG. 3 are schematic illustrations of a drive substrate of the embodiments, and an illustration of a structure of a surface light emitting element array chip.

Figure 4:
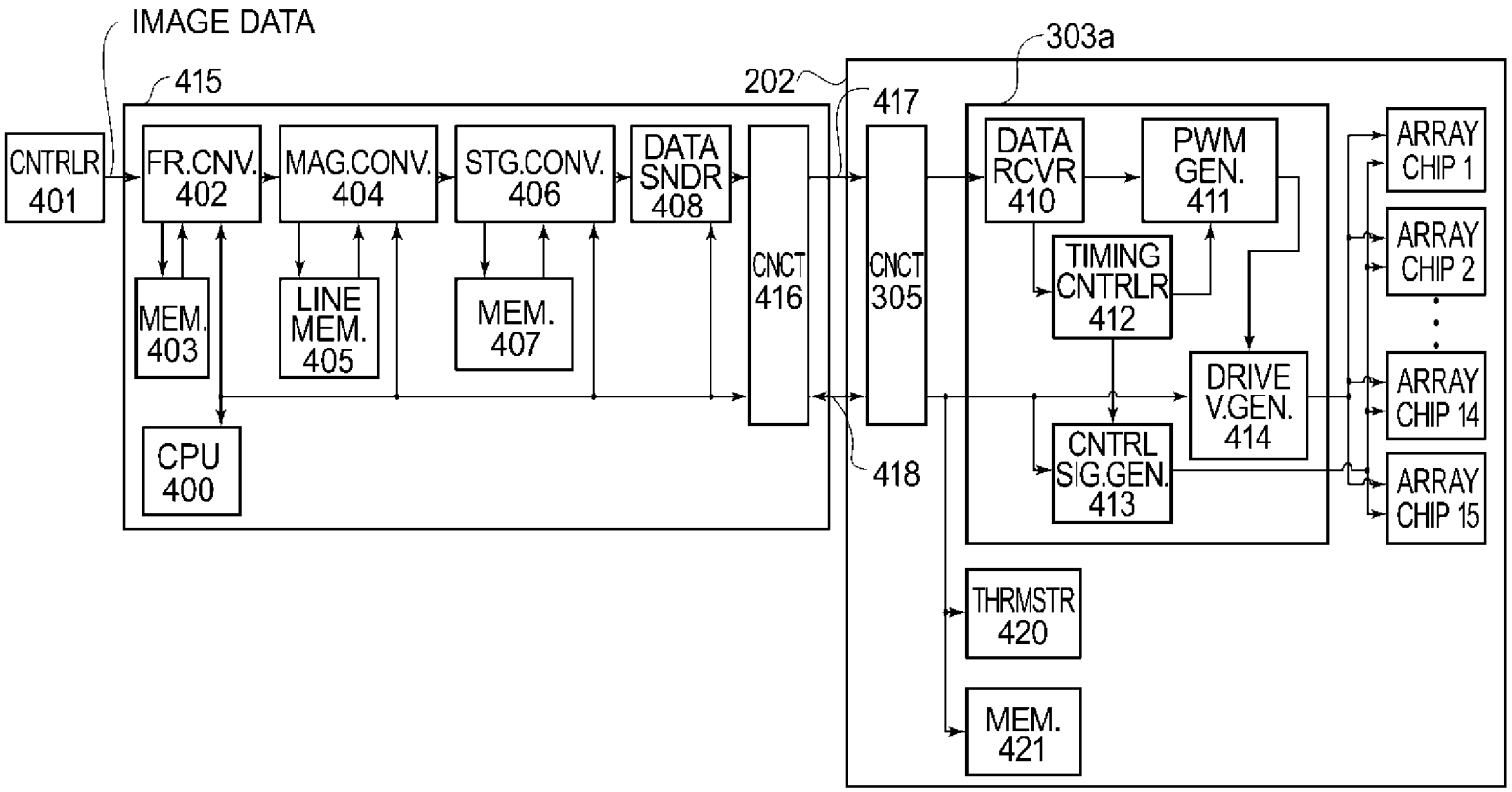

FIG. 4 is a control block diagram of a control surface and the drive substrate exposure head in the embodiment.

Figure 5:
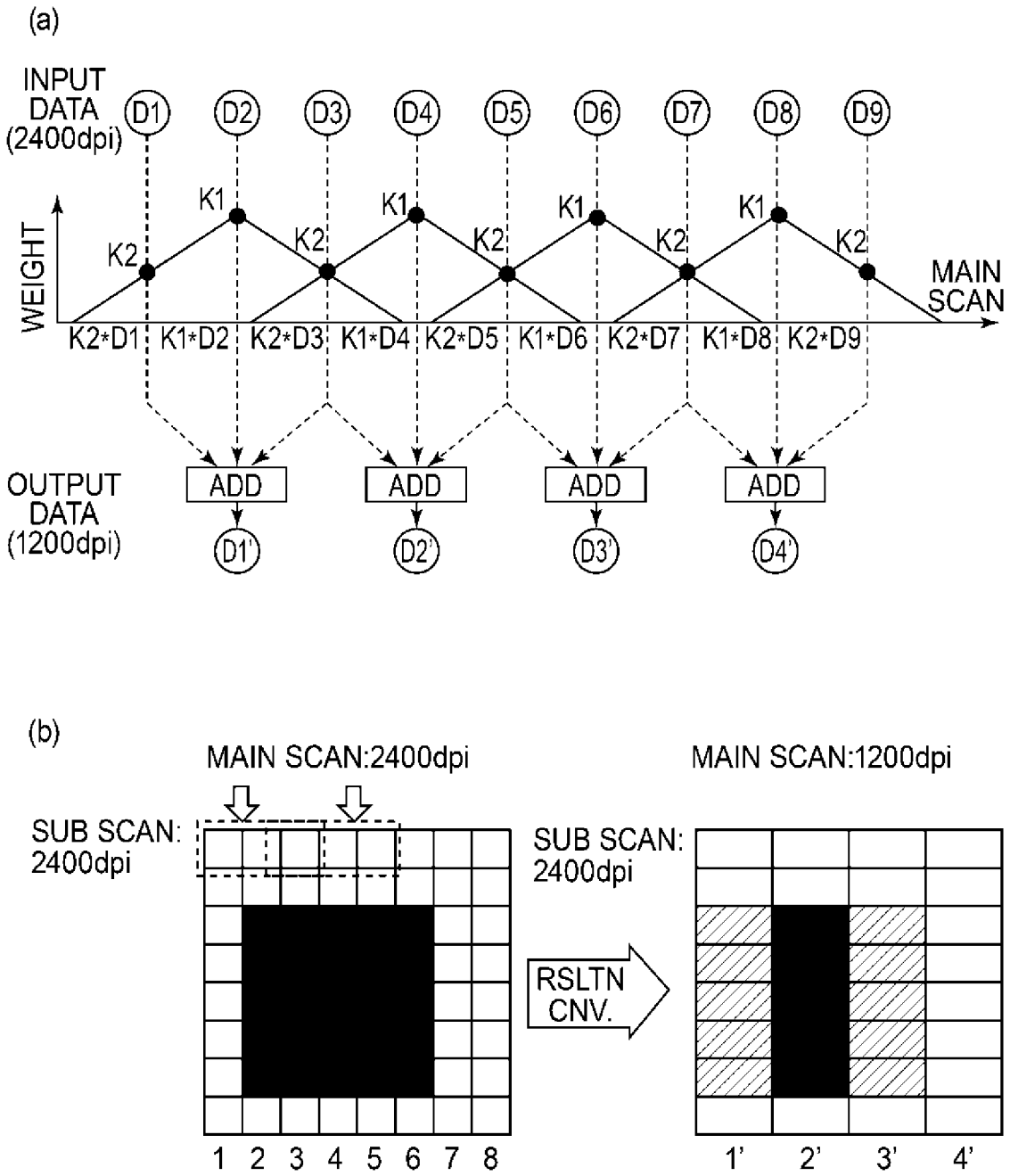

Part (a) and (b) of FIG. 5 are views illustrating filter processing of the embodiments 1.

Figure 6:
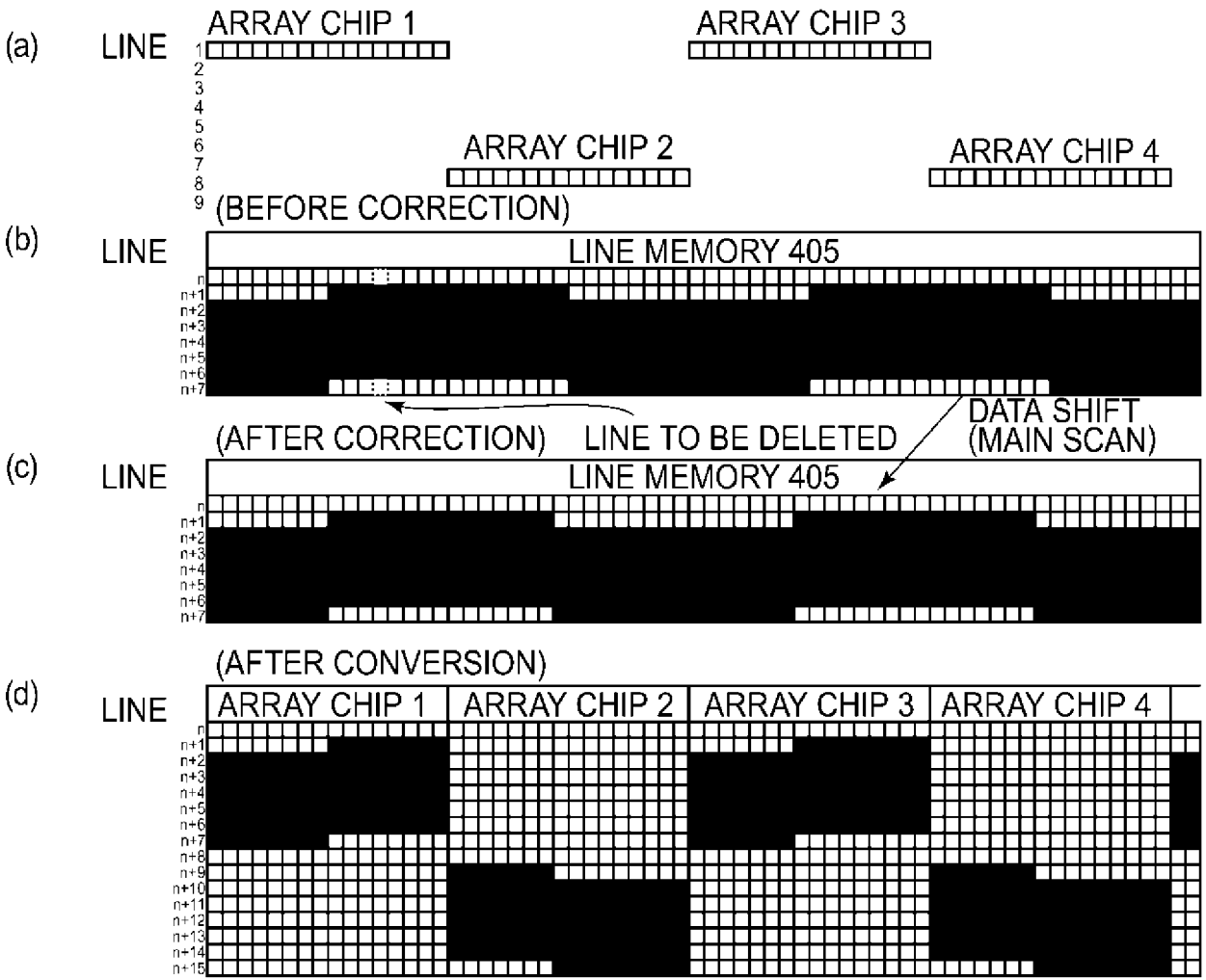

Parts (a) to (d) of FIG. 6 are views illustrating a main scan magnification correcting process and a staggered conversion process in the embodiment.

Figure 7:
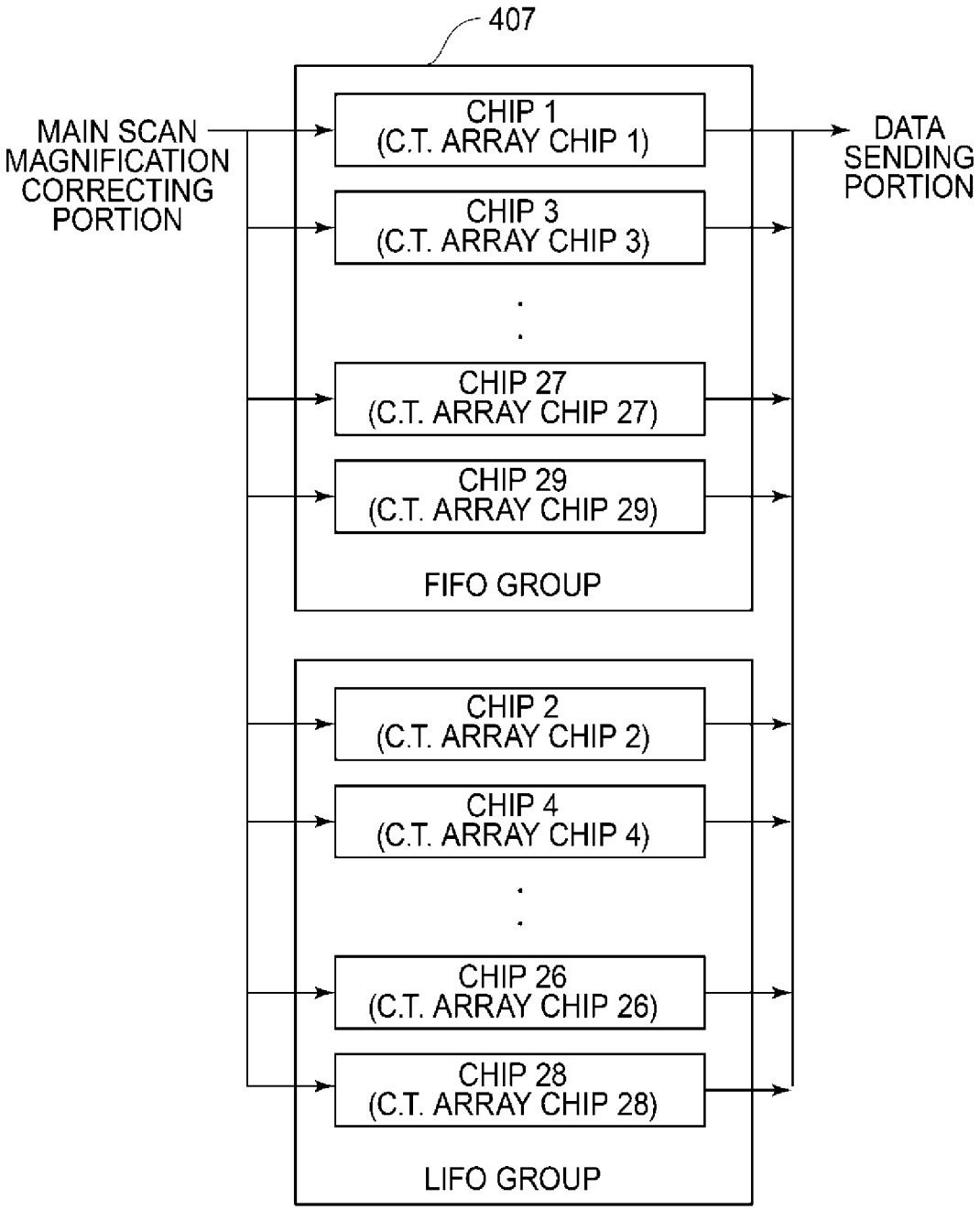

FIG. 7 is view illustrating a memory constitution of a staggered conversion circuit in the embodiment.

Figure 8:
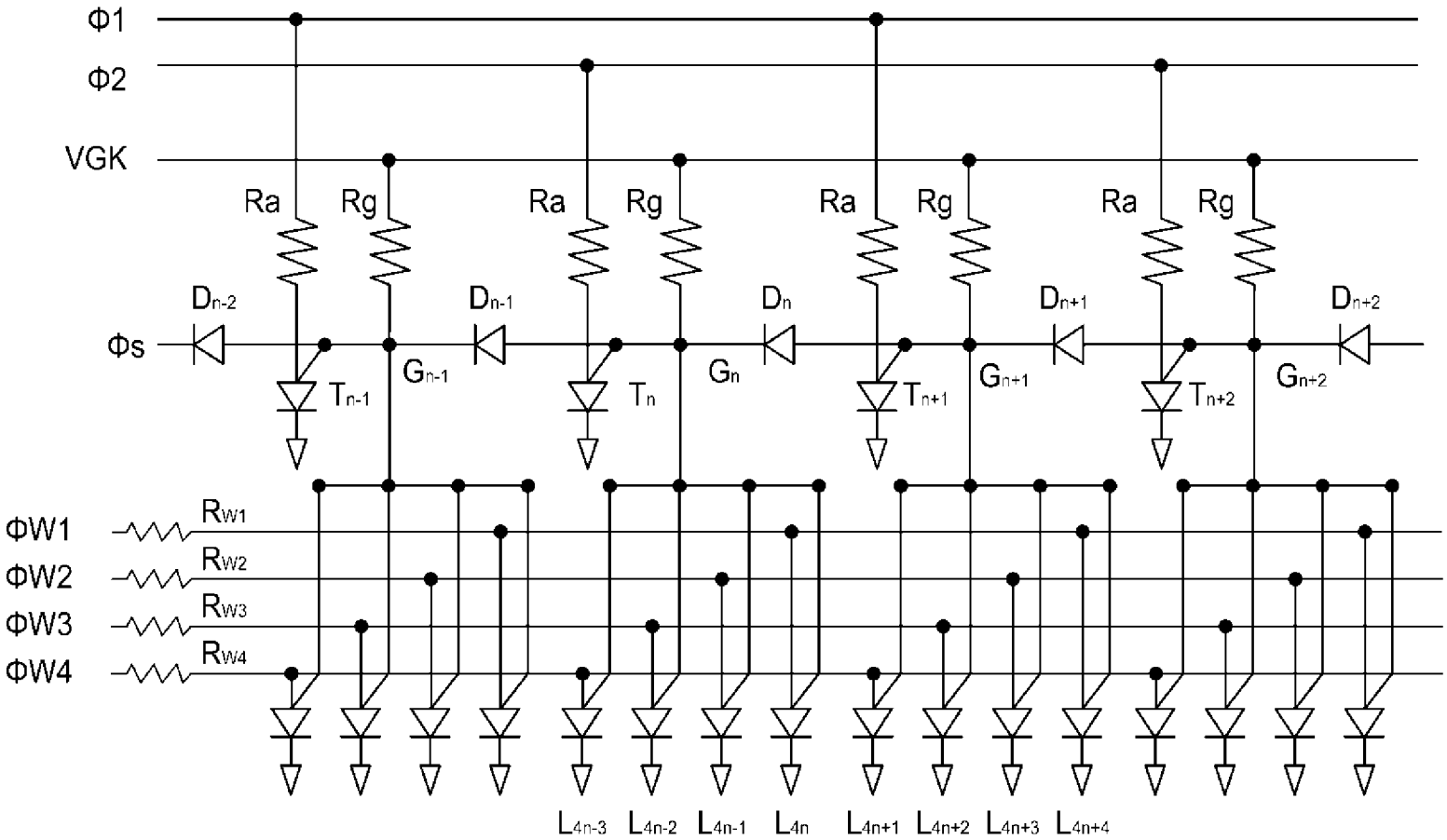

FIG. 8 is a view illustrating a circuit of the surface light emitting element array chip of the embodiment.

Figure 9:
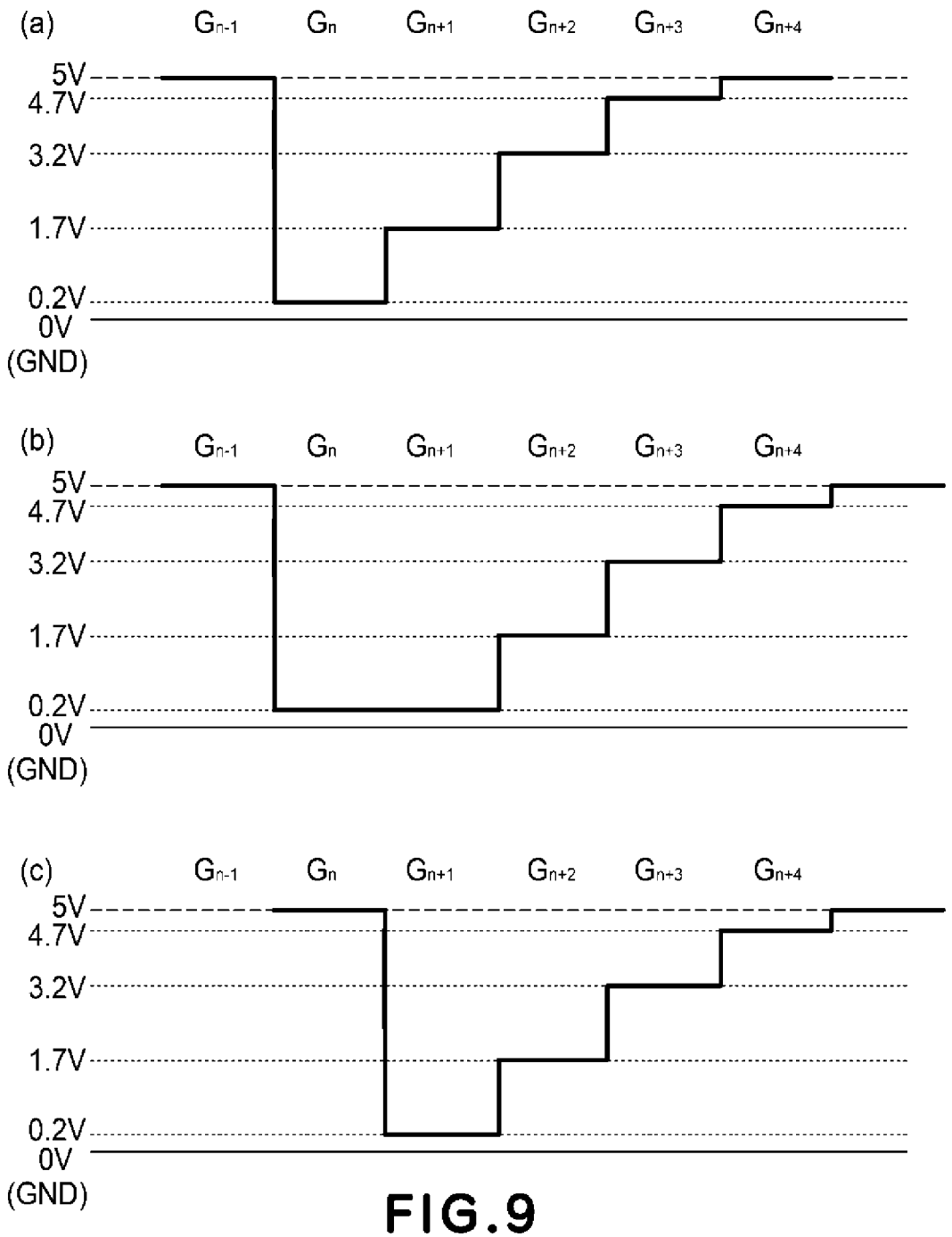

Parts (a), (b) and (c) of FIG. 9 are views illustrating a gate potential distribution of shift thyristors in the embodiment.

Figure 10:
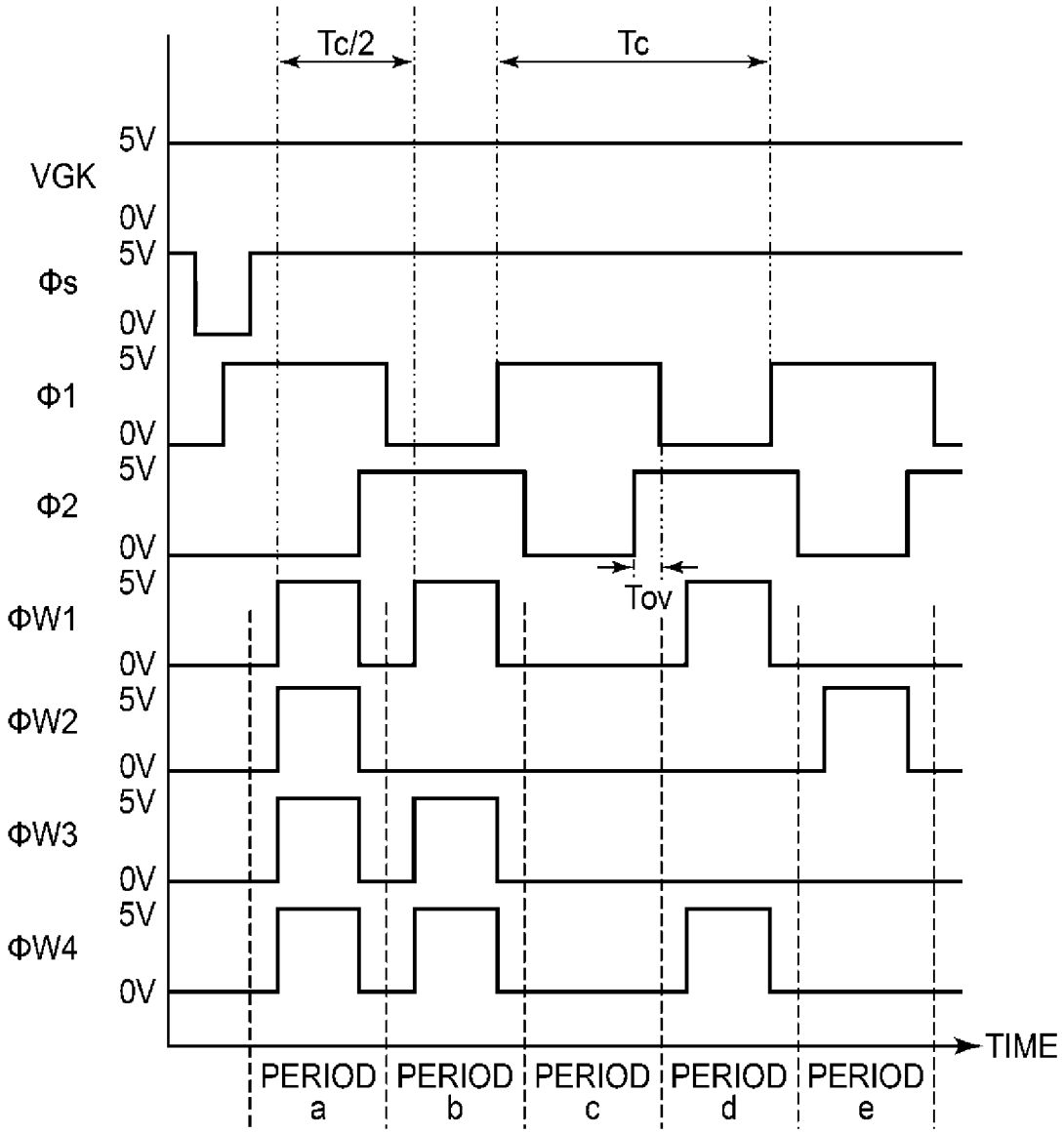

FIG. 10 shows drive signal waveforms of the surface light emitting element array chips in the embodiment.

Figure 11:
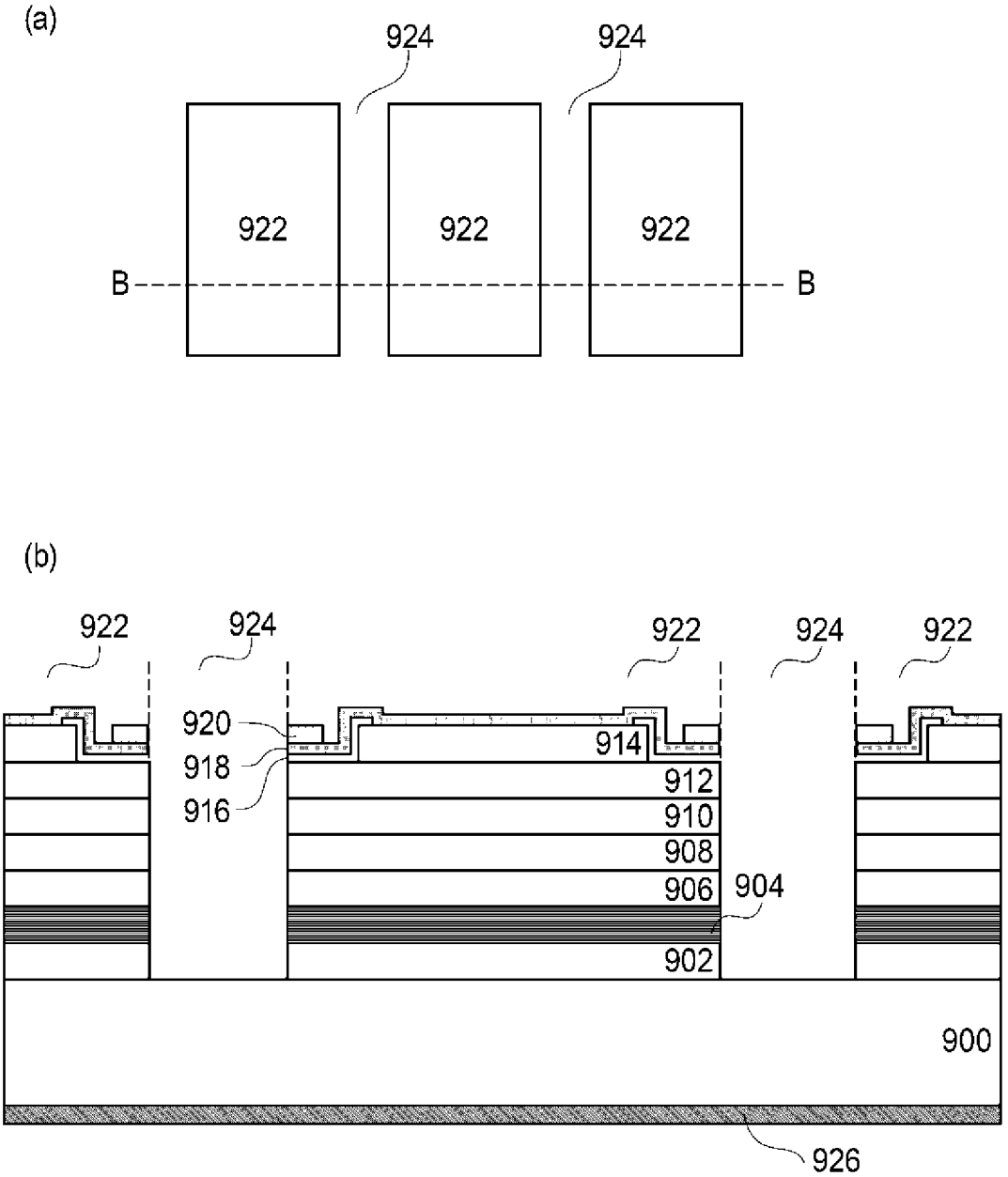

Parts (a) and (b) of FIG. 11 are cross-sectional views of a surface emitting thermistor of the embodiment.

DESCRIPTION OF EMBODIMENTS

In the following, embodiments of the present invention will be described in detail with reference to the drawings.

EMBODIMENT

[Structure of Image Forming Apparatus]

Figure 1:
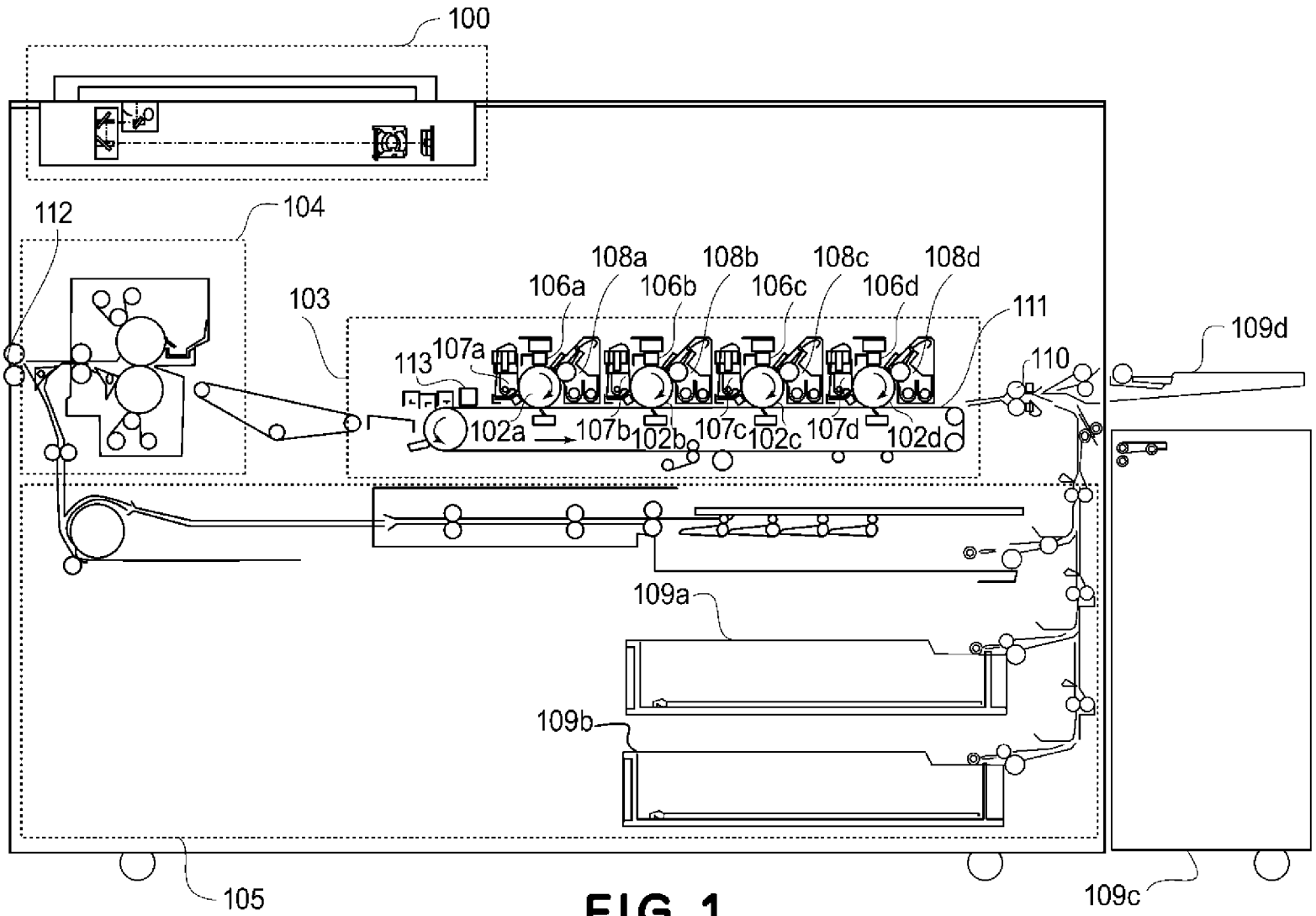
FIG. 1 is a schematic cross-sectional view illustrating a structure of an image forming apparatus of an embodiment 1.

FIG. 1 is a schematic cross-sectional view illustrating a structure of an electrophotographic image forming apparatus according to Embodiment 1. The image forming apparatus shown in FIG. 1 is a multifunction peripheral (MFP) including a scanner function and a printer function, and includes a scanner portion 100, an image forming portion 103, a fixing portion 104, the sheet feeding portion 105, and a printer controller (not shown). The scanner portion 100 illuminates an original placed on an original table, optically reads the original image, and converts the read image into an electrical signal to create image data.

The image forming portion 103 includes four image forming stations arranged along the rotational direction (counterclockwise direction) of an endless conveyance belt 111 in the order of a cyan (C) image forming station, a magenta (M) image forming station, a yellow (Y) image forming station, and a black (K) image forming station. The four image forming stations have the same structure, and each image forming station includes a photosensitive drum 102, which is a photosensitive member rotatable in a direction of an arrow (clockwise), an exposure head 106, a charging device 107, and a developing device 108. Here, the subscripts a, b, c, and d of the photosensitive drum 102, the exposure head 106, the charging device 107, and the developing portion 108 indicate that they are for black (K), yellow (Y), magenta (M), and cyan (C) image forming stations, respectively. Here, in the following, the suffixes are omitted except when referring to a specific photosensitive drum or the like.

In the image forming portion 103, the photosensitive drum 102 is driven to rotate, and the photosensitive drum 102 is charged by the charging device 107. The exposure head 106, which is the exposure portion, emits light from the arranged LED array according to the image data, and the light emitted from a surface of the LED array chip surface is collected on the photosensitive drum 102 (on the photosensitive member) by the rod lens array, so that an electrostatic latent image is formed. The developing device 108 develops the electrostatic latent image formed on the photosensitive drum 102 with toner. And, the developed toner image is transferred onto a recording sheet on a conveyance belt 111 which conveys the recording sheet. A series of such electrophotographic processes are executed at each image forming station. Here, during image formation, after a predetermined time has elapsed since image formation at the cyan (C) image forming station is started, image forming operations are executed sequentially at the magenta (M), yellow (Y), and black (K) image forming stations.

Here, as an example of the exposure portion employed in the image forming apparatus of the electrophotographic type, there is a laser beam scanning exposure type in which the photosensitive drum 102 is exposed to light through f-A lens or the like by scanning the photosensitive drum surface with irradiation beam of a semiconductor laser by a rotating polygonal mirror. The "exposure head 106" described in this embodiment is used in an LED exposure type in which the photosensitive drum 102 is exposed to light by using light emitting elements such as LEDs (Light Emitting Diodes) arranged along a rotational axis direction of the photosensitive drum 102, and is not used in the aforementioned laser beam scanning exposure type.

The image forming apparatus shown in FIG. 1 is provided with internal sheet feeding units 109*a* and 109*b* included in the sheet feeding portion 105 as units for feeding recording sheet, an external sheet feeding unit 109*c* which is a large capacity sheet feeding unit, and a manual sheet feed unit 109*d*.

During the image forming operation, recording sheet is fed from a sheet feeding portion designated in advance, and the fed recording sheet is fed to the registration roller 110. The registration roller 110 feeds the recording sheet to the conveyance belt 111 at such a timing that the toner image formed in the image forming portion 103 is transferred onto the recording sheet. The toner images formed on the photosensitive drum 102 of the respective image forming stations are sequentially transferred onto the recording sheet fed by the conveyance belt 111. The recording sheet on which the toner image (unfixed) has been transferred is fed to the fixing portion 104. The fixing portion 104 has a built-in heat source such as a halogen heater, and fixes the toner image on the recording sheet by heating and pressing with two rollers. The recording sheet on which the toner image is fixed by the fixing portion 104 is discharged to the outside of the image forming apparatus by the discharge roller 112.

On the downstream side of the black (K) image forming station in the recording sheet conveyance direction, an optical sensor 113 functioning as a detection portion is disposed at a position facing the conveyance belt 111. The optical sensor 113 detects the position of the test image formed on the conveyance belt 111 to determine the color misregistration amount of the toner image between each image forming station. The amount of color deviation detected by the optical sensor 113 is notified to a control board 415 (FIG. 5) which will be described hereinafter, and the image position of each color is corrected so that a full color toner image without color misregistration is transferred onto the recording sheet. In addition, in response to an instruction from the MFP controller (not shown) which controls the entire MFP (MFP), a printer controller (not shown) executes an image forming operation while controlling the above-described scanner portion 100, image forming portion 103, fixing portion 104, sheet feeding portion 105, and the like.

Here, as an example of an electrophotographic image forming apparatus, an image forming apparatus which directly transfers a toner image formed on the photosensitive drum 102 of each image forming station onto a recording sheet on the conveyance belt 111 has been described. The present invention is not limited to a printer which transfers the toner image from the photosensitive drum 102 directly onto the recording sheet. For example, the present invention can also be applied to an image forming apparatus including a primary transfer portion which transfers a toner image from the photosensitive drum 102 onto an intermediary transfer belt and a secondary transfer portion which transfers the toner image from the intermediary transfer belt onto the recording sheet.

[Structure of Exposure Head]

Next, for the exposure head 106 which is the exposure portion which exposes the photosensitive drum 102 will be explained referring to parts (a) and (b) of FIG. 2. Part (a) of FIG. 2 is a perspective view illustrating a positional relationship between the exposure head 106 and the photosensitive drum 102, and part (b) of FIG. 2 is a view illustrating an internal structure of the exposure head 106 and showing how the light beam from the exposure head 106 is condensed on the photosensitive drum 102 by the rod lens array 203. As shown in part (a) of FIG. 2, the exposure head 106 is mounted to the image forming apparatus by a mounting member (not shown) at a position facing the photosensitive drum 102 rotatable in a direction of an arrow (FIG. 1).

As shown in part (b) of FIG. 2, the exposure head 106 includes a drive substrate 202, a surface (planar) light-emitting-element array element group 201 mounted on the drive substrate 202, a rod lens array 203, and a casing 204. The rod lens array 203 and the drive substrate 202 are mounted to the casing 204. The rod lens array 203 condenses the light flux from the surface light-emitting-element array element group 201 on the photosensitive drum 102. At the factory, the exposure head 106 is assembled and adjusted by itself, and the focus and light intensity of each spot are adjusted. Here, the assembling and adjustment is performed such that a distance between the photosensitive drum 102 and the rod lens array 203 and a distance between the rod lens array 203 and the surface light-emitting-element array element group 201 are predetermined distances. By this, the light from the surface light-emitting-element array element group 201 is imaged on the photosensitive drum 102. Therefore, at the time of focus adjustment at the factory, the mounting position of the rod lens array 203 is adjusted so that the distance between the rod lens array 203 and the surface light-emitting-element array element group 201 is a predetermined value. In addition, when adjusting the light intensity at the factory, each surface light emitting element of the surface light-emitting-element array element group 201 is caused to emit light sequentially, and the drive current of each light emitting element is adjusted so that the light condensed on the photosensitive drum 102 via the rod lens array 203 has a predetermined light intensity.

[Structure of Surface Light-Emitting-Element Array Element Group]

Parts (a), (b) and (c) of FIG. 3 illustrate the surface-light-emitting-element array element group 201. Part (a) of FIG. 3 is a schematic illustration showing the structure of the surface (first surface) on which the surface light-emitting-element array element group 201 of the driving substrate 202 is mounted, and part (b) of FIG. 4 is a schematic illustration showing the structure of the surface (second surface) opposite to the first surface on which the light-emitting-element array element group 201 of the drive substrate 202 is mounted.

As shown in part (a) of FIG. 3, the surface emitting element array element group 201 mounted on the driving substrate 202 has a structure in which 29 surface emitting element array chips 1 to 29 are arranged in two rows in a staggered manner along the longitudinal direction of the driving substrate 202. Here, in part (a) of FIG. 3, the vertical direction indicates the first direction, which is the sub-scanning direction (the peripheral moving direction of rotation of the photosensitive drum 102), and the horizontal direction is the second direction perpendicular to the sub-scanning direction. Inside each surface light emitting element array chip, each element of the surface light emitting element array chip including a total of 516 light emitting points is arranged at a predetermined resolution pitch in the longitudinal direction of the surface light emitting element array chip. In this embodiment, the pitch of each element of the surface emitting element array chip is approximately 21.16 μm (≈2.54 cm/1200 dots), which means a resolution of 1200 dpi, and which is the first resolution. As a result, the distance from end to end of 516 light emitting points in one surface light emitting element array chip is about 10.9 mm (≈21.16 μm×516). The light-emitting-element array element group 201 comprises 29 surface light emitting element array chips. The number of surface light emitting elements which can be exposed in the light-emitting-element array element group 201 is 14,964 elements (=516 elements×29 chips), so that image formation corresponding to the image width in the main scanning direction of about 316 mm (≈about 10.9 mm×29 chips) is possible.

In this embodiment, each light emission point of the surface light emitting element array chip is a semiconductor LED, but each light emitting element may be, for example, an OLED (Organic Light Emitting Diode). This OLED, also called organic EL (Organic Electro-Luminescence), is a current-driven type light-emitting element. The OLEDs are arranged on a line along the main scanning direction (rotational axis direction of the photosensitive drum 102) on a TFT (Thin Film Transistor) substrate, for example, and are electrically connected to the power supply wiring provided along the main scanning direction, electrically in parallel.

Part (c) of FIG. 3 is an illustration showing a state of a boundary portion between the chips of the surface emitting element array chips arranged in two rows in the longitudinal direction; the horizontal direction is the longitudinal direction of the surface light-emitting-element array element group 201 in part (a) of FIG. 3. As shown in part (c) of FIG. 3, at the end of the surface emitting element array chip, there is provided a wire bonding pad to which a control signal is inputted, and a transfer portion and the light emitting element are driven by the signal fed from the wire bonding pad. In addition, the surface light emitting element array chip has a plurality of light emitting elements. At the boundary between the surface light emitting element array chips, the pitch of the light emitting elements in the longitudinal direction (the distance between the center point of the adjacent two light emitting elements) is approximately 21.16 μm, which is a 1200 dpi resolution pitch. In addition, the surface emitting element array chips arranged in two upper and lower rows include even-numbered surface light emitting element array chips on an upper side and odd-numbered surface light emitting element array chips on a lower side. Further, these surface light emitting element array chips are placed such that a light emitting point interval (indicated by an arrow S in the figure) of the upper and lower surface emitting element array chips is approx. 84 μm (distance of integer multiple of the resolution, that is, 4 pixels at 1200 dpi and 8 pixels at 2400 dpi).

Further, the even-numbered surface light emitting element array chips and the odd-numbered surface light emitting element array chips are mounted by changing a manner of arrangement of the surface light emitting elements by 180° so that an up-down direction is reversed. For that reason, when the respective surface light emitting element array chips of the surface light emitting element array chips 201 are caused to emit light, the odd-numbered surface light emitting element array chips emit light from an upstream side with respect to the main scan direction, and the even-numbered surface light emitting element array chips emit light from a downstream side with respect to the main scan direction. For that reason, light emission data toward the surface light emitting element array chips are transferred in the directions shown in part (c) of FIG. 3.

As shown in part (b) of FIG. 3, drive portions 303*a* and 303*b*, thermistor 420, a memory 421 and a connector 305 are mounted on the surface of the drive substrate 202 opposite to the surface on which the surface light-emitting-element array element group 201 is provided. The drivers 303*a* and 303*b* arranged on the respective sides of the connector 305 are each a drive IC for driving the surface light emitting element array chips 1 to 15 and the surface light emitting element array chips 16 to 29, respectively. The thermistor 420, which is a temperature detecting portion, detects the temperature on the drive substrate 202 (on the surface). The memory 421, which is a storing portion, stores arrangement information such as how to arrange the respective surface light emitting element array chips 1-29 on the drive substrate 202. The drive portions 303*a* and 303*b* are connected to the connector 305 via patterns 304*a* and 304*b*, respectively. Connector 305 is connected to signal lines, power supply voltage, and a ground wire for controlling drive portions 303*a* and 303*b* and the memory 421 from control surface (board) 415 (FIG. 4), which will be described hereinafter; thus, it is connected to drive portions 303*a* and 303*b*. In addition, from the drive portions 303*a* and 303*b*, a wiring for driving the surface light-emitting-element array element group 201 passes through an inner layer of the driving substrate 202 and is connected to the surface light emitting element array chips 1 to 15 and the surface light emitting element array chips 16 to 29.

[Control Substrate and Exposure Head Control Structure]

FIG. 4 shows a control substrate 415 which processes image data and outputs the processed data to the exposure head 106, and the drive substrate 202 which exposes the photosensitive drum 102 based on the image data inputted from the control substrate 415. As for the drive substrate 202, the surface emitting element array chips 1 to 15 controlled by the driving portion 303*a* shown in FIG. 4 will be described. Here, the surface emitting element array chips 16 to 29 controlled by the driving portion 303*b* (not shown in FIG. 4) also carry out the same operation as the surface emitting element array chips 1 to 15 controlled by the driving portion 303*a*. To simplify the explanation, the explanation will be made as to the image processing for one color here, although in the image forming apparatus of this embodiment, the same processing is carried out simultaneously in four colors. A control substrate 415 shown in FIG. 4 has a connector 416 for transmitting a signal for controlling the exposure head 106. From the connector 416, the image data and the control signal from the CPU 400 of the control substrate 415 are transmitted through the signal wires 417 and 418 connected to the connector 305 of the exposure head 106, respectively.

[Structure of Control Substrate (Board)]

In the control board 415, the CPU 400 which is a controller principally performs image data processing and processing for arrangement of the surface light emitting element array chips 1-29. The control board 415 includes functional blocks of a frequency conversion portion 402, a main scan magnification correction portion 404, a staggered conversion portion 406, and a data sending (transmission) portion 405. In the following, processing in each functional block will be described in the order in which image data on the control board 415 is processed.

(Frequency Conversion Circuit)

The frequency conversion portion 420 converts a transfer speed by subjecting the image data, sent from the controller 401 of the image forming apparatus, to frequency conversion. That is, the frequency conversion portion 402 writes input image data, sent from the controller 401, into the memory 403 and reads the input image data from the memory 403 at a frequency designated by the CPU 400, so that conversion of the transfer speed of the image data is carried out. Specifically, the frequency conversion portion 402 stores the input image data, sent from the controller at the frequency depending on resolution, in the memory 403. Then, the frequency conversion portion 402 performs a dithering (processing) such that the stored input image data is read from the memory 403 at the frequency providing the resolution designated by the CPU 400, and thus generates image data which is frequency-converted. In this embodiment, the frequency conversion portion 402 performs the dithering in which the resolution is twice that it was by reading twice the same input image data so that the input image data with the resolution of 1200 dpi sent from the controller becomes the resolution of 2400 dpi. As a result, the image data generated by the frequency conversion portion 402 is pixel data equivalent to 2400 dpi, and the transfer speed of the image data is also changed corresponding to the converted resolution. The pixel data equivalent to 2400 dpi in this example is 1 bit data, but one pixel may be expressed by a plurality of bits. The pixel data generated by the frequency conversion portion 402 is line data corresponding to a line corresponding in 2400 dpi resolution in the sub-scanning direction (the rotational direction of the photosensitive drum 102, that is, the conveyance direction of the recording sheet). And, the frequency conversion portion 402 generates pixel data corresponding to each pixel including a resolution equivalent to 2400 dpi in association with the position of the pixel in the main scanning direction (longitudinal direction of the exposure head 106). Incidentally, in this embodiment, the memory 403 is used for performing the frequency conversion, but a FIFO (First In First Out) image may also be used depending on a ratio of the conversion speed.

(Main Scan Magnification Correcting Portion)

Then, the image data which is subjected to frequency conversion (resolution conversion) by the frequency conversion portion 402 which is a correcting portion is inputted to a main scan magnification correcting portion 404 in a subsequent stage. In the main scan magnification correcting portion 404, filter(ing) processing of the inputted image data is carried out, so that the resolution of the image data is converted from 2400 dpi to 1200 dpi, and then, main scan magnification correction is carried out on the basis of temperature information of a thermistor 420.

(Filter(ing) Processing)

The main scan magnification correcting portion 404 performs the filter processing in which the resolution of an inputted negative image data in the main scanning direction from 2400 dpi to 1200 dpi, and the image data after the filter processing is stored in the memory 405. In this embodiment, the image data is interpolated by filtering in the main scanning direction. Part (c) of FIG. 5 is a view illustrating the state of the filter processing in the main scan magnification correcting portion 404. In part (a) of FIG. 5, references D1 to D9 depict image data of the surface light emitting element array chip (input data in 2400 dpi). Here, the image data D1 to D8 are the data of the corresponding surface light emitting element array chip, and the image data D9 is pixel data at the extreme end of the adjacent surface light emitting element array chip. D1' to D4' indicate image data (1200 dpi output data) after the filter processing portion 408 performs the filter processing. The resolution of output data (1200 dpi) is half of the resolution of input data (2400 dpi), and the calculation formula of image data of each pixel is expressed by the following (Formula 1)

$$Dn'=D(2\times n-1)\times K2+D(2\times n)\times K1+D(2\times n+1)\times K2 \quad \text{(Equation 1)}$$

Here, the value of the pixel position n is 1 to 14964. When n=14964, the extreme end data D (29929 (=14964×2+1)) has no adjacent surface light emitting element array chip, and therefore, is processed as white (0), for example. K1 as a first coefficient is a weighting coefficient for the output data and input data at the same coordinate position in the main scanning direction. K2 which is said second coefficient is a weighting coefficient for the input data including coordinates shifted by ½ pixel in the main scanning direction with respect to the output data. In this embodiment, interpolation calculation (filter processing) is performed with values of K1=0.5 and K2=0.25, but other weighting coefficients different from those of this embodiment may be used. In this embodiment, by setting the weight coefficient K2 to a value greater than 0, information of image data generated at a resolution (2400 dpi) higher than the resolution of output data (1200 dpi) can be reflected in the output data. More specifically, in the processing up to the previous stage, image position movement in the main scanning direction is performed at 2400 dpi, and then the resolution of the image data is converted to 1200 dpi by the main scan magnification correcting portion 404. By this, it is possible to generate 1200 dpi images while maintaining image movement accuracy in 2400 dpi units.

In addition, in performing the pixel processing at the end of the surface light emitting element array chip, using the filtering process, if there is no pixel data of the adjacent surface light emitting element array chip, the image is omitted with the result of occurrence of an image defect. Therefore, when processing the extreme edge pixel data, the processing is performed by adding pixel data on the end side of the adjacent surface light emitting element array chip, so that the image omission does not occur.

Part (b) of FIG. 5 is a view illustrating a change in image data by the filter processing. A left-hand view of part (b) of FIG. 5 is a view showing the image data of 2400 dpi after the dithering (process) at the frequency conversion portion 402, and the image data is represented by two gradation levels of black and white. Further, the ordinate represents the sub-scan direction, the abscissa represents the main scan direction, and 1 to 8 represent an arrangement order of the light emitting elements in the surface light emitting element array chips at 2400 dpi. A right-hand view of part (b) of FIG. 5 shows image data after, with respect to an image in the left-hand view, the image data in the main scan direction is subjected to resolution conversion from 2400 dpi to 1200 dpi by the filter processing. Incidentally, with respect to the abscissa direction, 1', 2', 3' and 4' represent the arrangement order of the light emitting elements of the surface light emitting element array chips after the resolution conversion into 1200 dpi is carried out. Further, a size of each pixel (1200 dpi) with respect to the main scan direction after the resolution conversion of the right-hand view of part (b) of FIG. 5 is twice a size of one (each) pixel (2400 dpi) shown in the left-hand view of part (b) of FIG. 5. In these views, in the case where a density value of a black portion is 100% and a density value of a white portion (including a frame portion which is not shown in the views) is 0%, when the density value of each pixel is calculated from the above-described Equation 1, the density value can be represented by 5 values of 0%, 25%, 50%, 75% and 100%. By processing the number of gradation levels of one pixel after the resolution conversion by 3 bits or more, it becomes possible to perform smooth processing with no occurrence of density level difference.

For example, the density value of the pixel 1' in the third row from the top of the right-hand view of part (b) of FIG. 5 is calculated in the following manner by using the (Equation 1) and the pixel density in the left-hand view of part (b) of FIG. 5. That is, pixel 1' density value=pixel 1 density (0)×K2(0.25)+pixel 2 density(1)×K1(0.5)+pixel 3 density (1)×K2(0.25)=0.75 (75%). In the right-hand view of part (b) of FIG. 5, a density value of 75% is expressed by hatching.

Similarly, the density value of the pixel 2' in the third row from the top of the right-hand view of part (b) of FIG. 5 is calculated in the following manner by using the (Equation 1) and the pixel density in the left-hand view of part (b) of FIG. 5. That is, pixel 2' density value=pixel 3 density(1)×K2 (0.25)+pixel 4 density(1)×K1(0.5)+pixel 5 density(1)×K2 (0.25)=1 (100%).

Furthermore, the density value of the pixel 4' in the third row from the top of the right-hand view of part (b) of FIG. 5 is calculated in the following manner by using the (Equation 1) and the pixel density in the left-hand view of part (b) of FIG. 5. That is, pixel 4' density value=pixel 7 density (0)×K2(0.25)+pixel 8 density(1)×K1(0.5)+adjacent pixel 1 density(0)×K2(0.25)=0 (0%).

Here, as an example, an example in which the filter processing of 3 pixels with respect to the main scan direction was described, but the main scan magnification correcting portion 404 includes a line memory 405, and therefore, for example, 3×3 filter processing using 3 pixels with respect to the main scan direction and 3 pixels with respect to the sub-scan direction may also be carried out.

(Main Scan Magnification Correction)

Then, main scan magnification correction in which deletion of the image data with respect to the main scan direction is made on the basis of temperature information of the thermistor 420 mounted on the exposure head 106 will be described. As described above, the surface light emitting element array chip includes many light emitting portions, so that a heat generation amount during light emission becomes large. For that reason, by the influence of the heat generation amount, thermal expansion of the drive substrate 202 on which the surface light emitting element array chips are mounted is invited, so that a length of the drive substrate 202 in the main scan direction becomes long and a width of the image written (formed) on the photosensitive drum also becomes long, and therefore there is a need to delete the pixel(s). For that reason, in the main scan magnification correction, on the basis of the temperature of the thermistor 420 provided on the drive substrate 202, an image width is corrected depending on a degree of extension (length fluctuation amount) of the drive substrate 202 in the main scan direction.

Table 1 is a table in which a temperature (° C.) acquired from the thermistor 420 and a main scan correction magnification (%) for correcting the image width are associated with each other. The number of the light emitting elements, capable of exposing the photosensitive drum to light, in the surface light emitting element array element group 201 is 14964 (elements), and is capable of meeting the image width of about 316 mm (≈about 10.9 mm×29 chips) with respect to the main scan direction. For example, from the table 1, the main scan correction magnification when a thermistor acquisition temperature is 30° C. is 0.0095238%. When the length, of about 316 mm, of the surface light emitting element array element group 201 is multiplied by this main scan correction magnification of 0.0095238%, about 30 μm results. A pitch of the resolution of 1200 dpi is approximately 21.16 μm, so that when the thermistor acquisition temperature is 30° C., there is a need that, of the image data, the image data corresponding to one pixel is deleted.

TABLE 1

| TAT*1 (° C.) | MSCM*2 (%) |
|---|---|
| 25 | 0.0000000 |
| 30 | 0.0095238 |
| 35 | 0.0190476 |
| 40 | 0.0285714 |
| 45 | 0.0380952 |
| 50 | 0.0476190 |
| 55 | 0.0571429 |
| 60 | 0.0666667 |

*1"TAT" is the thermistor acquisition temperature.
*2"MSCM" is the main scan correction magnification.

The CPU 400 acquires the temperature information from the thermistor 420 mounted on the exposure head 106. The CPU 400 includes the table 1 in which the temperature (° C.) acquired from the thermistor 420 and the main scan correction magnification (%) for correcting the image width are corresponded, and acquires the main scan correction magnification on the basis of the acquired temperature information of the main scan correction magnification. Then, the CPU 400 determines the number of items of the image data to be deleted on the basis of the acquired main scan correction magnification, and provides an instruction to the main scan magnification correcting portion 404 as to a pixel position of the image data to be deleted. The main scan magnification correcting portion 404 performs shift processing of the image data stored in the line memory 405, and then makes a deletion of the image data.

Incidentally, in this embodiment, deletion processing of the image data on the basis of the main scan correction magnification corresponding to the temperature information of the thermistor 420 was described. For example, a method in which the image data deletion processing is processing performed depending on the temperature of the exposure head 106 estimated on the basis of the number of times of light emission (video count) in the light emitting elements of the surface light emitting element array element group 201 may also be employed. The CPU 400 includes a table in which an integrated value, acquired by counting the number of light emissions in all the light emitting elements of the surface light emitting element array element group 201 in advance, a temperature of the exposure head 106 corresponding to the integrated value, and main scan correction magnification corresponding to the temperature of the exposure head 106 are associated with each other. Here, the value to be counted may also be the number of times of sending of the image data to the light emitting element array chips. Corresponding to the number of times of sending of the image data to the light emitting element array chips, the light emitting elements of the light emitting element array chips emit light. By counting this value, it is possible to estimate that the temperature of the light emitting element array chips becomes what degree of temperature. Then, the CPU 400 performs processing in which, of the image data, the image data for light emission is integrated and added, and acquires information on the main scan correction magnification corresponding to an integrated value from the table, and then the CPU 400 may also perform the image data deletion processing on the basis of the acquired main scan correction magnification.

(Staggered Conversion Portion)

The image data corrected in main scan magnification by the main scan magnification correcting portion 404 is inputted to a group conversion portion 406. The surface light emitting element array chips 1-29 are arranged in a staggered fashion such that the array chips are alternately disposed chip by chip with respect to the sub-scan direction as shown in part (a) of FIG. 3. In the memory 421, arrangement information (mounting position information) indicating how to arrange the respective surface light emitting element array chips 1-29 on the drive substrate 202 is stored.

For example, in the memory 421, information on the mounting position of each of the light emitting element array chips 2-29 relative to the light emitting element array chip 1 with respect to the sub-scan direction is stored. As described above, on design nominal, odd-numbered light emitting element array chips (1, 3, . . . 29) are mounted on the substrate 202 so that the light emitting elements of each odd-numbered light emitting element array chip are arranged in a line in the main scan direction. Further, on design nominal, even-numbered light emitting element array chips (2, 4, . . . 28) are mounted on the substrate 202 so that the light emitting elements of each even-numbered light emitting element array chip are arranged in a line in the main scan direction. Further, the even-numbered light emitting element array chips are disposed so as to shift from the odd-numbered light emitting element array chips by 4 pixels in terms of 1200 dpi. In the memory 421, information on a difference in mounting position between the odd-numbered light emitting element array chip and the even-numbered light emitting element array chip is stored. As the information on the difference, it is possible to cite data indicating that these array chips are shifted from each other by 4 pixels in terms of 1200 dpi and data indicating that these array chips are shifted from each other by 84 μm (≈21.16 μm×4) as an example. Further, information on the difference may also be data indicating a difference in relative light emission timing between the odd-numbered light emitting element array chip and the even-numbered light emitting element array chip. In this case, depending on which is disposed on an upstream side with respect to a rotational direction of the photosensitive drum as to the odd-numbered light emitting element array chips and the even-numbered light emitting element array chips, whether or not the odd-numbered light emitting element array chips and the even-numbered light emitting element array chips are caused to emit light in a delayed manner is determined. For that reason, the memory 421 may also store the data indicating that which is disposed on the upstream side with respect to the rotational direction of photosensitive drum as to the odd-numbered light emitting element array chips and the even-numbered light emitting element array chips, in combination.

As another example, in the memory 421, information on a deviation amount, with respect to the sub-scan direction, of each light emitting element array chip relative to the light emitting element array chip 1 as a reference may also be stored. That is, the degree of how much each of the light emitting element array chips 2-29 is deviated from the light emitting element array chip 1 is actually measured by a measuring device in the factory, and the memory 421 may also store arrangement information based on a result thereof. In this case, for the odd-numbered light emitting element array chips (3, 5, . . . 29), arrangement information relating to a mounting error D relative to the light emitting element array chip 1 is stored in the memory 421. Further, for the odd-numbered light emitting element array chips (2, 4, . . . 28), an arrangement relating to 84 μm+mounting error D relative to the light emitting element array chip 1 is stored in the memory 421.

The CPU 400 reads the arrangement information from the memory 421, and on the basis of the arrangement information, divides the image data among memories corresponding to the respective surface light emitting element array chips. In this embodiment, the surface light emitting element array chips are arranged in the sub-scan direction, and therefore, the memory 407 for maintaining the image data is connected to the staggered conversion portion 406.

Parts (a) to (d) of FIG. 6 are views illustrating processes of the above-described main scan magnification correcting portion 404 and the staggered conversion portion 406. Part (a) of FIG. 6 is a view showing a positional relationship among the respective surface light emitting element array chips with respect to the main scan direction and the sub-scan direction, and in FIG. 6, the surface light emitting element array chips 1-4 are shown. Incidentally, in this embodiment, each of the surface light emitting element array chips 1-4 includes light emitting elements corresponding to 16 pixels. As shown in part (a) of FIG. 6, the resolution of the image data with respect to the sub-scan direction is 2400 dpi, and therefore, the surface light emitting element array chips 1-4 are alternately disposed in a staggered fashion at positions separated from each other by a distance corresponding to 8 lines with respect to the sub-scan direction.

Parts (b) and (c) of FIG. 6 are views illustrating the processing of the above-described main scan magnification correcting portion 404. Part (b) of FIG. 6 is the view showing the image data stored in the line memory 405 after the filter processing in the main scan magnification correcting portion 404. The line in an ordinate direction represents the line number with respect to the sub-scan direction. In the figure, solid black boxes represent image data of 100% in density. In part (b) of FIG. 6, boxes which are enclosed by a broken line at the same position with respect to the main scan direction and which are arranged in the sub-scan direction represent an image data column to be deleted by the main scan magnification correction. Part (c) of FIG. 6 is the view showing the image data stored in the line memory 405 after the main scan magnification correction processing is carried out. In part (c) of FIG. 6, of the image data shown in part (b) of FIG. 6, the image data positioned on a side downstream of the image data to be deleted, with respect to the main scan direction, are shifted toward the upstream side with respect to the main scan direction by one pixel, and thus the main scan magnification correction processing is carried out.

Part (d) of FIG. 6 is a view in which the image data of part (c) of FIG. 6 are rearranged in the main scan direction and the sub-scan direction on the basis of the arrangement information of the respective surface light emitting element array chips 1-29 stored in the memory 421. Of the surface light emitting element array chips 1-29, the odd-numbered surface light emitting element array chips and the even-numbered light emitting element array chips are separated from each other by 8 lines (in the case of the resolution of 2400 dpi) with respect to the sub-scan direction. Further, the respective image data are divided among the memories 407 corresponding to the respective surface light emitting element array chips and are stored in the memories 407.

As described above, in this embodiment, after the image data is subjected to the main scan magnification correction processing, the image data is divided among the memories corresponding to the associated surface light emitting element array chips. In a conventional technique, after the image data are once divided among the memories corresponding to the surface light emitting element array chips, the main scan magnification correction processing for deleting the image data is carried out by shifting the image data. For that reason, the shift of the image data is performed among the memories corresponding to the surface light emitting element array chips, and therefore, a complicated mechanism (circuit structure) for performing the shift of the image data is needed and thus leads to an increase in cost. On the other hand, in this embodiment, before the image data are divided among the memories 407 corresponding to the associated surface light emitting element array chips, the main scan magnification correction processing, in which the image data is subjected to the shift processing on the memory, is performed. For that reason, after the image data are divided among the memories 407 corresponding to the associated surface light emitting element array chips, there is no need to perform the shift of the image data among the memories corresponding to the surface light emitting element array chips, so that a simple circuit structure can be realized.

FIG. 7 is a view illustrating a structure of the memory 407 in which the image data are stored. In the memory 407, the image data inputted from the main scan magnification correcting portion 404 are written, and are outputted to the data sending portion 408 for sending the image data to the driving portion 303*a* mounted on the drive substrate 202 of the exposure head 106. The memory 407 is constituted by a FIFO group including memories in which the image data to be sent to the odd-numbered surface light emitting element array chips are stored and by a LIFO group including memories in which the image data to be sent to the even-numbered surface light emitting element array chips are stored. Incidentally, LIFO is an abbreviation of Last In First Out, and the LIFO group includes memories of a last in first out type. In the memories of the FIFO group, the image data stored in the memories corresponding to the respective light emitting element array chips are sequentially outputted to the data sending portion 408 from the image data positioned on the upstream side of the main scan direction. On the other hand, in the LIFO group, in which the memories corresponding to the even-numbered surface light emitting element array chips are accommodated, output of the image data is performed in the following manner. That is, the image data stored in the memories corresponding to the respective surface light emitting element array chips are sequentially outputted to the data sending portion 408 from the image data positioned on the downstream side of the main scan direction. This is because, as described with reference to part (c) of FIG. 3, the even-numbered surface light emitting element array chips are mounted with respect to an opposite direction to the mounting direction of the odd-numbered surface light emitting element array chips and thus an image data transfer direction that is opposite to that of the odd-numbered surface light emitting element array chips is achieved.

As described with reference to part (c) of FIG. 3, in the arrangement of the odd-numbered surface light emitting element array chips and the even-numbered surface light emitting element array chips, an order of arrangement of the light emitting elements to be turned on is different from each other by 180°. For that reason, a transfer direction of the image data transferred to the odd-numbered surface light emitting element array chips is taken as a normal direction. Then, there is a need that the transfer direction of the image data transferred to the even-numbered surface light emitting element array chips is made the opposite direction, and thus a light emission order of the light emitting elements of the even-numbered surface light emitting element array chips is made opposite to the light emission order of the light emitting elements of the odd-numbered surface light emitting element array chips. For that reason, in the memory 407 of the staggered conversion portion 406, for the memories corresponding to the even-numbered surface light emitting element array chips, a constitution in which an image data sending order is reversed is needed, and therefore, the LIFO group is used. The image data (line data) are inputted in the normal direction (a direction from an upstream side to a downstream side of the main scan direction) by the main scan magnification correcting portion 404. For the memories of the FIFO group corresponding to the odd-numbered surface light emitting element array chips, the inputted image data are outputted to the data sending portion 408 without changing the sending order. For example, in the case where the image data ("110000") are inputted by the main scan magnification correcting portion 404, the image data are outputted to the data sending portion 408 in the order of "110000". On the other hand, for the memories of the LIFO group corresponding to the even-numbered surface light emitting element array chips, the inputted image data are outputted to the data sending portion 408 in a manner such that the sending order is changed to a reverse order. For example, in the case where the image data ("110000") are inputted by the main scan magnification correcting portion 404, the image data are outputted to the data sending portion 408 in the order of "000011".

Incidentally, the memory 407 may also be constituted by a memory element such as an SRAM (Static Random Access Memory) or a DRAM (Dynamic Random Access Memory) or by a flip-flop circuit. Further, a storing device or the like provided outside the control substrate 415 may be used.

(Data Sending Portion)

The image data subjected to the staggered conversion processing by the staggered conversion portion 406 are transferred to the drive substrate 202 of the exposure head 106 via connectors 416 and 305 in the data sending portion 408. Specifically, the image data are inputted from the connector 416 on the control substrate 415 side to the connector 305 of the drive substrate 202 on the exposure head 106 side via a signal line (wire) 417. Further, a communication signal from the CPU 400 is inputted from the connector 416 on the control substrate 415 side to the connector 305 of the drive substrate 202 on the exposure head 106 side via a signal line (wire) 418.

[Exposure Head Driver]

(Data Receiver)

Next, the processing inside the drive portion 303*a* of the exposure head 106 will be described.

The drive portion 303*a* mounted on the drive substrate 202 includes functional blocks of a data receiving portion 410, a PWM signal generation portion 411, a timing controller 412, a control signal generation portion 413, and a drive voltage generation portion 414. In the following, the processing of each functional block will be described in the order in which image data is processed by the drive portion 303*a*. Here, the staggered conversion portion 406 of the control substrate 415 arranges image data for each of the 29 surface light emitting element array chips, and the subsequent processing blocks are constituted to process each image data stored in the 29 chips in parallel. The driving portion 303*a* includes a circuit which receives image data corresponding to the surface light emitting element array chips 1 to 15 and can process each surface light emitting element array chip in parallel.

(Data Receiver)

The data receiving portion 410 receives a signal transmitted from the data sending (transmitting) portion 408 of the control board 415. Here, the data receiving portion 407 and the data sending portion 405 send (transmit) and receive image data in the portion of lines in the sub-scanning direction in synchronization with the line synchronization signal.

(PWM Signal Generator, Timing Controller, Control Signal Generator, Drive Voltage Generator)

The PWM signal generator 411 generates a pulse width signal (hereinafter referred to as the pulse width signal) provided corresponding to the light emission time performed in one pixel portion by the surface emitting element array chip in accordance with the data value for each pixel. The timing for outputting the PWM signal is controlled by the timing controller 412. The timing controller 412 generates a synchronization signal corresponding to the pixel section of each pixel from the line synchronization signal extracted from the data receiving portion 410, and outputs the synchronization signal to the PWM signal generation portion 411. The drive voltage generator 414 generates a drive voltage for driving the surface light emitting element array chip in synchronization with the PWM signal. Here, the drive voltage generation portion 414 has a structure in which the voltage level of the output signal can be adjusted around 5V so that the CPU 400 provides a predetermined light intensity. In this embodiment, each surface light emitting element array chip is constituted such that four light emitting elements can be driven independently from each other at the same time. The drive voltage generator 414 supplies drive signals to 4 lines of drive signals for each surface light emitting element array chip, that is, for the entire exposure head 106, the drive voltage generator 414 supplies drive signals to 60 staggered lines ((15 chips)×4=60 lines). Drive signals supplied to each light emitting element array chip are ΦW1 to ΦW4 (FIG. 8). On the other hand, the surface light emitting element chip array is sequentially driven by the operation of a shift thyristor (FIG. 8), which will be described hereinafter. The control signal generation portion 413 generates control signals Φs, Φ1, and Φ2 for transferring the shift thyristor for each pixel from the synchronization signal corresponding to the pixel portion generated by the timing controller 412 (FIG. 8).

[SLED Circuit]

FIG. 8 is an equivalent circuit in which a part of the self-scanning LED (SLED) chip array of this embodiment is extracted. In FIG. 8, Ra and Rg are anode resistance and gate resistance, respectively, Tn is a shift thyristor, Dn is a transfer diode, and Ln is a light emitting thyristor. In addition, Gn depicts a common gate of the corresponding shift thyristor Tn and the light emitting thyristor Ln connected to the shift thyristor Tn. Here, n is an integer of 2 or more. Φ1 is a transfer line of an odd-numbered shift thyristor T, and Φ2 is a transfer line of an even-numbered shift thyristor T. ΦW1 to ΦW4 are lighting signal lines for the light-emitting thyristor L, and are connected to resistors RW1 to RW4, respectively. VGK is a gate line, and Φs is a start pulse line. As shown in FIG. 8, four light emitting thyristors L4*n*-3 to L4*n* are connected to one shift thyristor Tn, and the four light emitting thyristors L4*n*-3 to L4*n* can be turned on simultaneously.

[Operation of SLED Circuit]

The operation of the SLED circuit shown in FIG. 8 will be described. Here, in the circuit illustration of FIG. 8, it is assumed that 5V is applied to the gate line VGK, and the voltages inputted to the transfer lines Φ1, Φ2 and the lighting signal lines ΦW1 to ΦW4 are also 5V. In FIG. 8, when the shift thyristor Tn is on, the potential of the common gate Gn of the light-emitting thyristor Ln connected to the shift thyristor Tn and the shift thyristor Tn is lowered to about 0.2V. The common gate Gn of the light emitting thyristor Ln and the common gate Gn+1 of the light emitting thyristor Ln+1 are connected by a coupling diode Dn, and therefore, a potential difference substantially equal to the diffusion potential of the coupling diode Dn is generated. In this embodiment, the diffusion potential of the coupling diode Dn is about 1.5V, and therefore, the potential of the common gate Gn+1 of the light emitting thyristor Ln+1 is 1.7V (=0.2V+1.5V) obtained by adding 1.5V of the diffusion potential to 0.2V of the potential of the common gate Gn of the light emitting thyristor Ln. Similarly, the potential of the common gate Gn+2 of the light emitting thyristor Ln+2 is 3.2V (=1.7V+1.5V), and the potential of the common gate Gn+3 (not shown) of the light emitting thyristor Ln+3 (not shown) is 4.7V (=3.2V+1.5V) However, the potential after the common gate Gn+4 of the light-emitting thyristor Ln+4 is 5V because the voltage of the gate line VGK is not higher than this, and therefore, it is 5V. In addition, as to the potential of the common gate Gn−1 before the common gate Gn of the light emitting thyristor Ln (left side of the common gate Gn in FIG. 8), the coupling diode Dn−1 is reverse biased, and therefore, the voltage of the gate line VGK is applied as it is, and it is 5V.

Part (a) of FIG. 9 is an illustration showing the distribution of the gate potential of the common gate Gn of each light-emitting thyristor Ln when the above-described shift thyristor Tn is in the on state, in which the common gates Gn−1, Gn, Gn+1, and so on depict the common gates of the light emitting thyristors L in FIG. 8. In addition, the vertical axis of part (a) in FIG. 9 indicates the gate potential. The voltage required to turn on each shift thyristor Tn (hereinafter referred to as the threshold voltage) is substantially the same as the gate potential of the common gate Gn of each light-emitting thyristor Ln plus the diffusion potential (1.5V). When the shift thyristor Tn is on, the shift thyristor Tn+2 has the lowest gate potential of the common gate among the shift thyristors connected to the transfer line Φ2 of the same shift thyristor Tn. The potential of the common gate Gn+2 of the light emitting thyristor Ln+2 connected to the shift thyristor Tn+2 is 3.2V (=1.7V+1.5V) (part (a) of FIG. 9) as described above. Therefore, the threshold voltage of the shift thyristor Tn+2 is 4.7V (=3.2V+1.5V) However, shift thyristor Tn is on, and therefore, the potential of transfer line Φ2 is drawn to about 1.5V (diffusion potential), and it is lower than the threshold voltage of shift thyristor Tn+2, so that shift thyristor Tn+2 cannot be turned on. Other shift thyristors connected to the same transfer line Φ2 have a higher threshold voltage than the shift thyristor Tn+2, and therefore, it cannot be turned on, either, and only the shift thyristor Tn can be kept on.

In addition, for shift thyristors connected to transfer line Φ1, the threshold voltage of the shift thyristor Tn+1 where the threshold voltage is the lowest is 3.2V (=1.7V+1.5V). Next, the shift thyristor Tn+3 (not shown in FIG. 8) having the lowest threshold voltage is 6.2V (=4.7V+1.5V). In this state, when 5V is inputted to the transfer line Φ1, only the shift thyristor Tn+1 can be turned on. In this state, the shift thyristor Tn and the shift thyristor Tn+1 are in the on-state simultaneously. Therefore, gate potentials of shift thyristors Tn+2, Tn+3, and so on provided on the right side of the shift thyristor Tn+1 in the circuit shown in FIG. 8 is lowered by the amount corresponding to the diffusion potential (1.5V) However, the voltage of the gate line VGK is 5V, and the common gate voltage of the light emitting thyristor L is limited by the voltage of the gate line VGK, and therefore, the gate potential on the right side of the shift thyristor Tn+5 is 5V. Part (b) of FIG. 9 shows the gate voltage distribution of each of the common gates Gn−1 to Gn+4 at this time, in which the vertical axis represents the gate potential. In this state, when the potential of the transfer line Φ2 is lowered to 0V, the shift thyristor Tn is turned off, and the potential of the common gate Gn of the shift thyristor Tn is increased to the VGK potential. Part (c) of FIG. 9 is an illustration showing the gate voltage distribution at this time, in which the vertical axis shows the gate potential. In this manner, the on-state transfer from the shift thyristor Tn to the shift thyristor Tn+1 is completed.

[Light Emission Operation of Light Emitting Thyristor]

Next, a light emitting operation of the light emitting thyristor will be described. When only the shift thyristor Tn is on, the gates of the four light emitting thyristors L4*n*-3 to L4*n* are connected in common to the common gate Gn of the shift thyristor Tn. Therefore, the gate potentials of the light emitting thyristors L4*n*-3 to L4*n* are 0.2V, which is the same as that of the common gate Gn. Therefore, the threshold value of each light emitting thyristor is 1.7V (=0.2V+1.5V), and if a voltage of 1.7V or more is inputted from the lighting signal lines ΦW1 to ΦW4 of the light emitting thyristors, the light emitting thyristors L4*n*-3 to L4*n* can be turned on. Therefore, by inputting a lighting signal to the lighting signal lines ΦW1 to ΦW4 when the shift thyristor Tn is on, the four light emitting thyristors L4*n*-3 to L4*n* can selectively emit light. At this time, the potential of the common gate Gn+1 of the shift thyristor Tn+1 next to the shift thyristor Tn is 1.7V, and the threshold voltage of the light emitting thyristors L4*n*+1 to L4*n*+4 connected to the common gate Gn+1 is 3.2V (=1.7V+1.5V). The lighting signal inputted from lighting signal lines ΦW1 to ΦW4 is 5V, and therefore, the light-emitting thyristors L4*n*+1 to L4*n*+4 are likely to light up with the same lighting pattern as the light-emitting thyristors L4*n*-3 to L4*n*. However, the threshold voltage is lower in the light emitting thyristors L4*n*-3 to L4*n*, and therefore, when a lighting signal is inputted through the lighting signal lines ΦW1 to ΦW4, they turn on earlier than light-emitting thyristors L4*n*+1 to L4*n*+4. Once the light emitting thyristors L4*n*-3 to L4*n* are turned on, the connected lighting signal lines ΦW1 to ΦW4 are lowered to about 1.5V (diffusion potential). Therefore, the potential of the lighting signal lines ΦW1 to ΦW4 becomes lower than the threshold voltage of the light emitting thyristors L4*n*+1 to L4*n*+4, and therefore, the light emitting thyristors L4*n*+1 to L4*n*+4 cannot be turned on. As described above, by connecting the multiple light-emitting thyristors L to one shift thyristor T, the plurality of light-emitting thyristors L can be turned on simultaneously.

FIG. 10 is a timing chart of the drive signals for the SLED circuit shown in FIG. 8. FIG. 10 shows the voltage waveforms of the drive signals for the gate line VGK, the start pulse line Φs, the odd-numbered and even-numbered shift thyristor transfer lines Φ1, Φ2, and the light-emitting thyristor lighting signal lines ΦW1-ΦW4, in this order from top to bottom. Here, each drive signal has an on-state voltage of 5V and an off-state voltage of 0V. In addition, the abscissa (horizontal axis) in FIG. 10 indicates time. In addition, Tc indicates the period of the clock signal Φ1, and Tc/2 indicates a period that is half (=½) of the period Tc.

The voltage of 5V is always applied to the gate line VGK. In addition, the clock signal Φ1 for the odd-numbered shift thyristor and the clock signal Φ2 for the even-numbered shift thyristor are inputted at the same period Tc, and 5V is supplied as the signal Φs for the start pulse line. To make a potential difference on the gate line VGK shortly before the clock signal Φ1 for the odd-numbered shift thyristor first becomes 5V, the signal Φs on the start pulse line is dropped to 0V. By this, the gate potential of the first shift thyristor Tn−1 is lowered from 5V to 1.7V, so that the threshold voltage becomes 3.2V, and therefore it can be turned on by a signal from the transfer line Φ1. A voltage of 5V is applied to the transfer line Φ1, and 5V is supplied to the start pulse line Φs, slightly after the first shift thyristor Tn−1 is turned on, and thereafter, 5V is continuously supplied to the start pulse line Φs.

The structure is such that the transfer line Φ1 and the transfer line Φ2 have a time period Tov where the ON states (5V in this case) overlap each other, and are in a substantially complementary relationship. The light-emitting thyristor lighting signal lines ΦW1 to ΦW4 are transmitted in half the cycle of the transfer lines Φ1 and Φ2, and light up when 5V is applied under the condition that the corresponding shift thyristor is on. For example, in the period a, all four light emitting thyristors connected to the same shift thyristor are turned on, and in the period b, the three light emitting thyristors are turned on simultaneously. In addition, in the period c, all the light emitting thyristors are turned off, and in the period d, the two light emitting thyristors are turned on simultaneously. In the period e, only one light-emitting thyristor is turned on.

In this embodiment, the number of light emitting thyristors connected to one shift thyristor is four, but it is not limited to this example, and may be less or more than four depending on the situation. Here, in the circuit described above, the cathode of each thyristor is shared, but an anode common circuit can be used by appropriately inverting the polarity.

[Structure of Surface Light Emitting Thyristor]

Parts (a) and (b) of FIG. 11 illustrate the emitting thyristor portion of this embodiment. Part (a) of FIG. 11 is a plan view (schematic illustration) of a light-emitting element array in which a plurality of light-emitting elements formed in a mesa (trapezoidal) structure 922 are arranged. Part (b) of FIG. 11 is a schematic cross-sectional view of the light-emitting element formed in the mesa structure 922 taken along a line BB shown in part (a) of FIG. 11. The mesa structures 922 in which the light emitting elements are formed are arranged at a predetermined pitch (interval between adjacent light emitting elements) (for example, approximately 21.16 μm in the case of 1200 dpi resolution), and they are separated from each other by grooves 924.

In part (b) of FIG. 11, reference numeral 900 depicts a compound semiconductor substrate of the first conductivity type; 902 is a buffer layer of the same first conductivity type as the substrate 900; and 904 is a distributed Bragg reflection (DBR) layer comprising a stack of two types of semiconductor layers of the first conductivity type. In addition, reference numeral 906 depicts a first conductivity type semiconductor layer; 908 is a first second-conductivity-type semiconductor layer different from the first conductivity type; 910 is a second first-conductivity type semiconductor layer; and 912 is a second second-conductivity-type semiconductor layer. As shown in part (b) of FIG. 11, a pnpn type (or npnp type) thyristor structure is formed by alternately laminating semiconductors having different conductivity types of the semiconductor layers 906, 908, 910 and 912. In this embodiment, the substrate 900 is an n-type GaAs substrate, the buffer layer 902 is an n-type GaAs or an n-type AlGaAs layer, and the DBR layer 904 is a laminated structure of an n-type high Al composition AlGaAs layer and a low Al composition layer. The n-type AlGaAs is used for the first first-conductivity-type semiconductor layer 906 on the DBR layer, and the p-type AlGaAs is used for the first second-conductivity-type semiconductor layer 908. In addition, the second first-conductivity-type semiconductor layer 910 uses n-type AlGaAs, and the second second-conductivity-type semiconductor layer 912 uses p-type AlGaAs.

In addition, in the mesa structure type surface light emitting element, the light emission efficiency is improved by using a current confinement mechanism to prevent the current from flowing to the side surface of the mesa structure 922. Here, the current confinement mechanism in this embodiment will be described. As shown in part (b) of FIG. 11, in this embodiment, a p-type GaP layer 914 is formed on a p-type AlGaAs, which is the second second-conductivity-type semiconductor layer 912, and an ITO layer 918, which is an n-type transparent conductor, is further formed thereon. The p-type GaP layer 914 is formed with a sufficiently high impurity concentration in the portion in contact with the ITO layer 918 of the transparent conductor. When a forward bias is applied to the light emitting thyristor (for example, when the back electrode 926 is grounded and a positive voltage is applied to the front electrode 920), a tunnel junction is established because the p-type GaP layer 914 is formed with a sufficiently high impurity concentration in the portion in contact with the ITO layer 918 of the transparent conductor. As a result, the current flows. With such a structure, the p-type GaP layer 914 concentrates the current on the portion of the n-type transparent conductor in contact with the ITO layer 918 to form a current confinement mechanism. Here, in this embodiment, an interlayer of insulating layer 916 is provided between the ITO layer 918 and the p-type AlGaAs layer 912. However, the mounted diode formed by the n-type ITO layer 918 and the p-type AlGaAs layer 912 is reverse-biased with respect to the forward bias of the light-emitting thyristor, and therefore, when the forward-bias is applied, basically no current flows other than at the tunnel junction. Therefore, it can be omitted, if the reverse diode withstand voltage of the mounted diode formed by the n-type ITO layer 918 and the p-type AlGaAs layer 912 is sufficient for the required usage. With this structure, the light is emitted by the semiconductor lamination portion under the portion substantially equivalent to the portion where the p-type GaP layer 914 and the n-type transparent conductor ITO layer 918 are in contact, and the DBR layer 904 reflects most of the emitted light to the opposite side of the substrate 900.

In the exposure head 106 in this embodiment, the density of light emitting points (interval between light emitting elements) is determined depending on the resolution. The light emitting elements inside the surface light emitting element array chip are separated into mesa structures 922 by element separating grooves 924, and, when forming an image with a resolution of 1200 dpi, for example, the distance between the element centers of adjacent light emitting elements (light emitting points) is arranged to be 21.16 μm.

As described above, in this embodiment, in the case where the main scan magnification correction depending on the fluctuation in length of the exposure head 106 with respect to the main scan direction is made, staggered conversion is carried out after the main scan magnification correction is performed by the main scan magnification correcting portion 404. As a result, it becomes possible to suppress the magnification fluctuation with respect to the main scan direction due to thermal expansion of each exposure head 106 without generating main scan magnification correction trace. In addition, it becomes possible to correct the magnification with respect to the main scan direction by the main scan magnification correcting portion 404, and therefore, there is no need to add a new mechanism, so that it becomes possible to suitably correct the main scan magnification while suppressing an increase in cost.

As described above, according to this embodiment, the magnification correction with respect to the main scan direction is carried out with a simple constitution, so that a deterioration of the output image can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-002581 filed on Jan. 10, 2019, which is hereby incorporated by reference herein in its entirety.

What is claimed is:

1. An image forming apparatus, comprising:

a rotatable photosensitive drum;

an exposure portion including a plurality of light emitting elements which are arranged in a rotational axis direction of said photosensitive drum and which emit light to which said photosensitive drum is exposed; and a controller configured to control activation of said light emitting elements by outputting image data to said exposure portion, wherein said exposure portion comprises:

a plurality of array chips, each including said light emitting elements, a substrate on which said array chips are arranged in a staggered fashion in the rotational axis direction, and a temperature detecting portion configured to detect a temperature of said substrate, wherein said controller comprises:

a correcting portion configured to correct magnification of the image data with respect to the rotational axis direction depending on a length fluctuation amount of said substrate with respect to the rotational axis direction calculated on the basis of the temperature detected by said temperature detecting portion, and a converting portion configured to arrange the image data on the basis of mounting positions of said array chips arranged in the staggered fashion, and wherein depending on magnification correction by the correcting portion, the image data is arranged by the converting portion on the basis of the mounting positions of said array chips.

2. An image forming apparatus according to claim 1, wherein said controller counts a number of items of the image data sent to the array chips, and wherein said correcting portion calculates the length fluctuation amount of the surface on the basis of the temperature of said surface estimated on the basis of the counted number of the items of the image data.

3. An image forming apparatus according to claim 1, wherein depending on the calculated length fluctuation amount of said surface, said correcting portion detects the image data corresponding to an arbitrary light emitting element of said light emitting elements arranged in the rotational axis direction.

4. An image forming apparatus according to claim 1, wherein said exposure portion includes a storing portion, in which mounting position information, which is information on the mounting positions of said array chips arranged on said surface, is stored and wherein said converting portion arranges the image data on the basis of the mounting position information acquired from said storing portion.

5. An image forming apparatus according to claim 1, wherein array chips are arranged in two rows in the rotational axis direction, and wherein a plurality of light emitting elements of said array chips in one row and a plurality of light emitting elements of said array chips in the other row are opposite in light emission order to each other.

6. An image forming apparatus according to claim 1, wherein said light emitting elements are LEDs.

* * * * *